US005692476A

United States Patent [19]

Egler et al.

[11] Patent Number: 5,692,476

[45] Date of Patent: Dec. 2, 1997

[54] FUEL INJECTION DEVICE FOR INTERNAL COMBUSTION ENGINES

[75] Inventors: Walter Egler, Stuttgart; Peter Boehland, Steinheim, both of Germany

[73] Assignee: Robert Bosch GmbH, Stuttgart, Germany

[21] Appl. No.: 722,084

[22] PCT Filed: Feb. 2, 1996

[86] PCT No.: PCT/DE96/00161

§ 371 Date: Oct. 18, 1996

§ 102(e) Date: Oct. 18, 1996

[87] PCT Pub. No.: WO96/26362

PCT Pub. Date: Aug. 29, 1996

[30] Foreign Application Priority Data

Feb. 21, 1995 [DE] Germany ..... 29502829 U

[51] Int. Cl.[6] ..... F02M 41/00

[52] U.S. Cl. ..... 123/456; 123/458; 137/517

[58] Field of Search ..... 123/198 D, 198 DB, 123/456, 467

[56] References Cited

U.S. PATENT DOCUMENTS

| | | | |
|---|---|---|---|
| 3,845,785 | 11/1974 | McMath | 137/517 |
| 4,077,376 | 3/1978 | Thoma | 123/467 |
| 4,246,876 | 1/1981 | Bouwkamp et al. | 123/467 |
| 4,436,111 | 3/1984 | Gold et al. | 137/517 |
| 4,539,959 | 9/1985 | Williams | 123/198 DB |
| 4,589,393 | 5/1986 | Jourde et al. | 123/198 DB |
| 4,830,046 | 5/1989 | Holt | 137/517 |
| 4,842,198 | 6/1989 | Chang | 137/517 |
| 5,295,469 | 3/1994 | Kariya et al. | 123/467 |
| 5,511,528 | 4/1996 | Iwanaga et al. | 123/198 DB |
| 5,577,479 | 11/1996 | Popp | 137/517 |

*Primary Examiner*—Thomas N. Moulis

*Attorney, Agent, or Firm*—Edwin E. Greigg; Ronald E. Greigg

[57] ABSTRACT

A fuel injection device for internal combustion engines with a high pressure fuel pump that delivers fuel from a low pressure chamber via high pressure lines to at least one injection valve that protrudes into the combustion chamber of the engine to be fed. The device includes a through flow limiting valve that defines a maximum fuel flow quantity in one or a number of high pressure lines and has a valve member, which can move axially and in its closed position, can be brought against a valve seat counter to the force of a restoring spring by fuel flowing toward the injection valve when a maximum fuel flow quantity is exceeded. Wherein the fuel flow through the valve member that is lifted up from its seat can be adjusted in at least one throttle location in the valve member. In order to be able to detect even extremely small leakage quantities, the through flow limiting valve is designed so that in each injection, the valve member executes a stroke motion toward the valve seat but only reaches it when there is a leaky high pressure line, wherein when there are low leakage quantities, the initial position of the valve member moves toward the valve seat during the injection pauses.

7 Claims, 3 Drawing Sheets

FUEL INJECTION DEVICE FOR INTERNAL COMBUSTION ENGINES

PRIOR ART

The invention is based on a fuel injection device for internal combustion engines. In a fuel injection device of this kind disclosed by a prior German Patent Application with the serial number P 44 142 42.0, a high pressure fuel pump delivers fuel from a low pressure chamber into a high pressure accumulation chamber, which is connected via high pressure lines to the individual injection valves that protrude into the combustion chamber of the engine to be fed, wherein this common pressure storage system (common rail) can be adjusted to a particular pressure by a pressure control device on the high pressure pump so that the injection pressure at the injection valves can be determined independent of speed over the entire operating performance graph of the engine to be fed. To control the injection times and injection quantities at the injection valve, an electrically controlled control valve is inserted into the high pressure line at each of these injection valves and with its opening and closing, controls the high pressure fuel injection at the injection valve.

Furthermore, the known fuel injection device has through flow limiting valves in the high pressure lines, which are intended to close the line in the event of a leak in order to thus reliably prevent an uncontrolled escape of fuel and the dangers connected with it. To this end, the through flow limiting valve has a movable valve member that is pressed counter to the force of a restoring spring by the fuel flowing against this valve member so that it seals against a valve seat the moment a particular pressure drop occurs in the high pressure line downstream of the through flow limiting valve and thus closes the high pressure line.

The known through flow limiting valve, though, has the disadvantage that it only reacts to relatively large leakage quantities so that smaller leakage quantities can occur unnoticed.

ADVANTAGES OF THE INVENTION

The fuel injection device according to the invention has the advantage over the prior art that even small leakage quantities in the high pressure lines are detected and result in a closing of these lines by means of the respective through flow limiting valve. Due to this detection of damages, even at very small through flow rates, injection valves which are not closing completely, for example, can also be detected and switched off from the operation of the motor so that severe resultant damages to the motor can be prevented.

The reaction of the through flow limiting valve, even when there are small leakage quantities, occurs advantageously by means of the matching, according to the invention, of the valve member throttle cross section of the through flow limiting valve and the force of the restoring spring as a function of the flow rate in the injection valve, which occurs so that throttle cross section and spring force are set so low that even during an injection at the injection valve when the high pressure line is intact, the valve member is slid toward the valve seat.

This valve member stroke produced by the pressure drop in the high pressure line between the through flow limiting valve and the injection valve, though, is smaller than its maximum stroke path until contact against the valve seat in the closed position of the through flow limiting valve.

When the high pressure line and injection valve are intact, the valve member returns to its original position once more as a result of the equal pressure increase in the high pressure line upstream and downstream of the through flow limiting valve when the injection valve is closed. In contrast, when there is damage, the valve member does not come back to its original starting position because of the pressure difference so that the subsequent stroke motion toward the valve seat is executed from an increased initial level, until the through flow limiting valve closes.

This advantageously lends the through flow limiting valve an integrating character, which makes it possible to detect even small leakage quantities and close the corresponding line. With large leakage quantities, the pressure in the line between the through flow limiting valve and the injection valve drops so sharply that the fuel flowing against the valve member immediately moves it until it reaches the valve seat so that in this instance, the through flow limiting valve immediately closes.

The valve member of the through flow limiting valve is embodied in a structurally simple manner as a cup-shaped piston, where the throttle location is constituted, for example, by the through flow opening in its closed end face.

Alternatively, it is possible to provide the throttle location in a throttle insert introduced into the valve member, which insert can be easily exchanged, which simplifies the adaptation to the respective requirements of the individual injection systems.

For a reliable valve closure, the sealing face and the valve seat are embodied as conical, where the respective angles are laid out so that the sealing face end of the exit openings of the through flow openings in the closed end face are disposed upstream of the effective sealing edge when considered in the flow direction toward the injection valve.

It is particularly advantageous to dispose the through flow limiting valves in the high pressure lines of a fuel injection device provided with a high pressure accumulation chamber (common rail) since in this injection device, a leaky line between the high pressure accumulation chamber and the injection valve would lead to the failure of the entire injection system, however, with through flow limiting valves, an emergency operation of the remaining injection valves is still possible.

Further advantages and advantageous embodiments of the subject of the invention can be inferred from the description, the drawings.

BRIEF DESCRIPTION OF THE DRAWINGS

Two exemplary embodiments of the fuel injection device according to the invention for internal combustion engines are shown in the drawings and explained in detail below.

DESCRIPTION OF THE EXEMPLARY EMBODIMENTS

Figure 1:
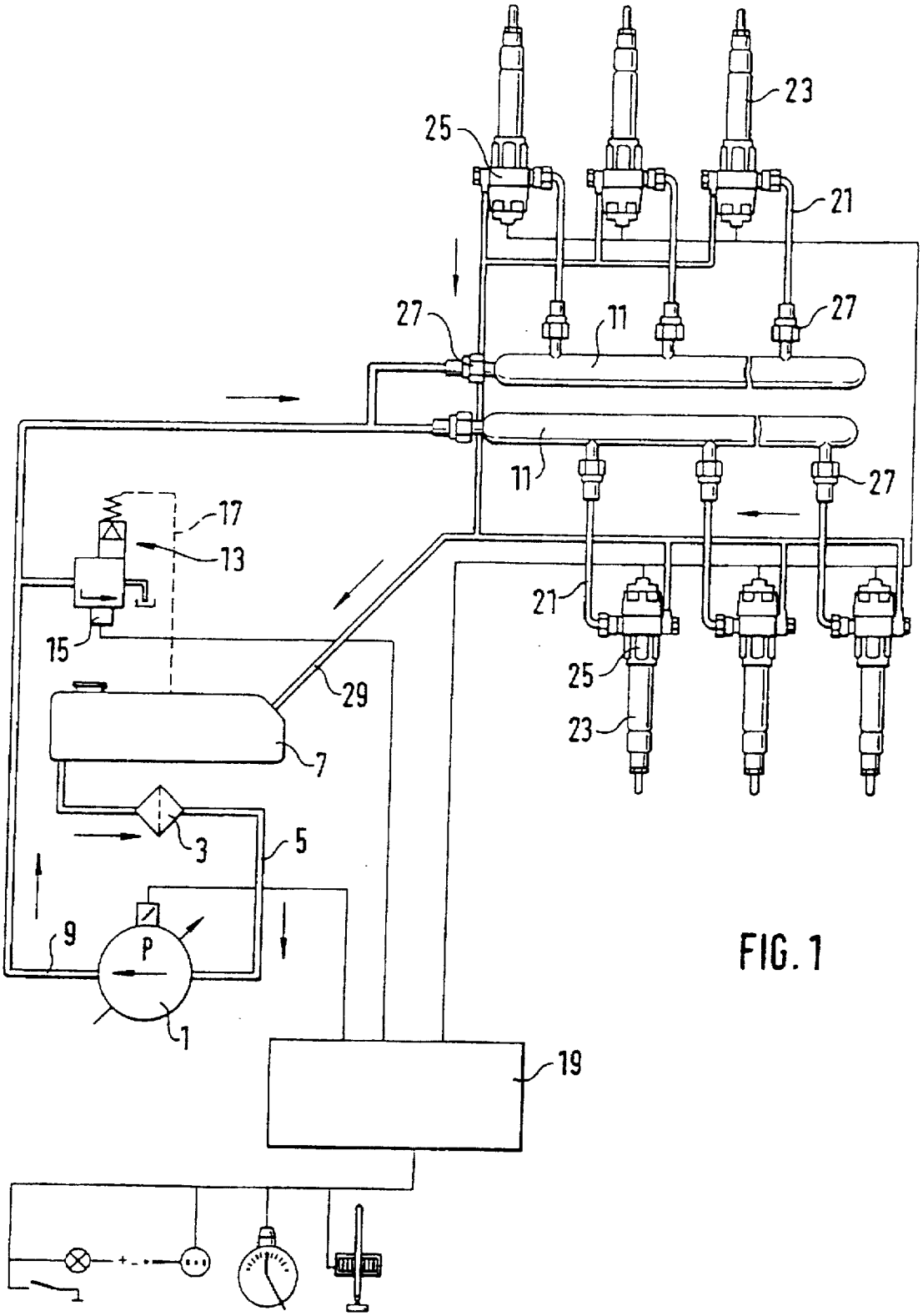
FIG. 1 is a schematic representation of the design of the fuel injection device with the inserted through flow limiting valves.

FIG. 1 shows a fuel injection device for internal combustion engines, in which a high pressure fuel pump 1, which can be embodied as a piston pump for example, delivers fuel via an intake line 5 that has a filter 3, from a low pressure chamber 7 embodied as a fuel tank, via a supply line 9 with high pressure into two high pressure accumulation chambers 11 disposed parallel to each other. The control of the pressure in the supply line 9 and in the high pressure accumulation chambers 11 is carried out in a known manner by means of a pressure valve, not shown, in a return line, likewise not shown, leading from the high pressure accumulation chambers 11 or from the supply line 9, and the regulation of the supply quantity of the high pressure fuel pump 1 takes place by means of an electronic control device 19 depending on the operational parameters of the engine to be fed.

Furthermore, high pressure lines 21 lead from the high pressure accumulation chambers 11 to the individual injection valves 23 that protrude into the combustion chamber of the engine to be fed, wherein to control the injection process, an electric control valve 25 that is triggered by the electric control device 19 is inserted into the respective high pressure line 21 of each injection valve 23, via which a communication can be opened between the injection valve 23 and a discharge line 29 leading away to the low pressure chamber 7.

In the event of a breakage of a high pressure line or of the supply line 9 at the high pressure accumulation chambers 11, in order to prevent an uncontrolled escape of fuel at this leak, through flow limiting valves 27 are furthermore provided in these lines 9, 21, which valves are preferably disposed close to or directly at the high pressure accumulation chambers 11.

The use of these through flow limiting valves 27 is also possible in all otherwise constructed fuel injection devices, for example in fuel injection devices with series pumps and without high pressure accumulation chambers.

Figure 2:
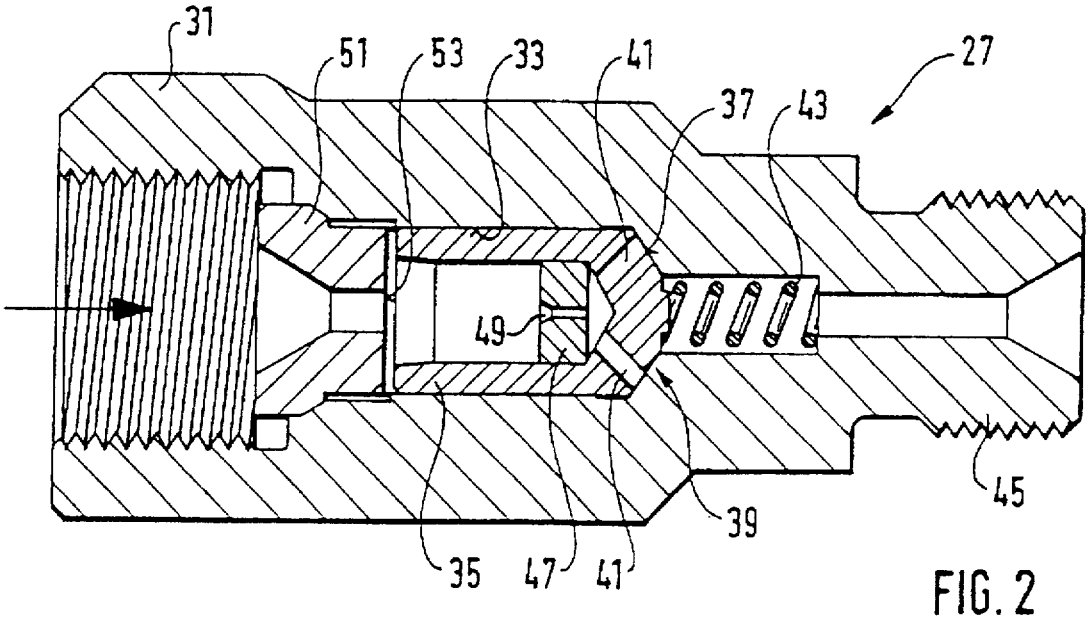
FIG. 2 shows a section through a first exemplary embodiment of a through flow limiting valve with a throttle insert.

The through flow limiting valve 27 shown in detail in FIG. 2 in the closed position has a valve body 31 in which a through bore 33 embodied as a stepped bore is provided, in which a cup-shaped valve member 35 is guided so that it can move axially. The valve member 35 has a conical transition surface between its cylindrical circumference face and its closed end wall, with which it constitutes a valve sealing face 37, which cooperates with a valve seat 39 formed on a conical cross sectional transition of the through bore 33.

Flow openings 41, preferably bores, are disposed in the valve sealing face 37, on its end remote from the valve seat 39; when the valve member 35 is lifted from the valve seat 39, fuel can flow via these openings from the inside of the valve member 35 to the valve seat 39 and from there on into a bore part that contains a restoring spring 43 which acts upon the valve member 35 in the opening direction of the through flow limiting valve 27, which bore part adjoins the part of the valve seat 39 remote from the valve member 35. The angles of the valve sealing face 37 and the valve seat 39 are designed so that the sealing face end outflow openings of the flow openings 41, viewed in the flow direction toward the injection valve, are disposed upstream of the sealing edge formed between the valve seat 39 and the valve sealing face 37.

The valve member 35 is inserted into the through bore 33 so that its open end points counter to the fuel flow direction to a connection of the valve body 31 with the supply line 9 or with the high pressure accumulation chamber 11 and its closed end that has the valve sealing face 37 points in the flow direction toward a connecting fitting 45 which is connected to the high pressure accumulation chamber 11 (upon insertion into the supply line 9) or the high pressure line 21 is connected to the injection valve 23.

On its inside, which is flowed through by fuel, the valve member 35 additionally has a throttle insert 47 that precedes the flow openings 41 and has a throttle location 49 that is preferably constituted by a throttle bore.

For a stroke limitation of the valve member 35 in the opening direction, a stop piece 51 with a through opening is inserted, preferably screwed, into the through bore 33 of the valve body 31 and its end face 53 oriented toward the valve member 35 forms a stop that cooperates with the open end face of the valve member 35. It is possible to adjust the opening stroke motion of the valve member 35 and consequently the opening cross section at the valve seat 39 via the screw-in depth.

Figure 3:
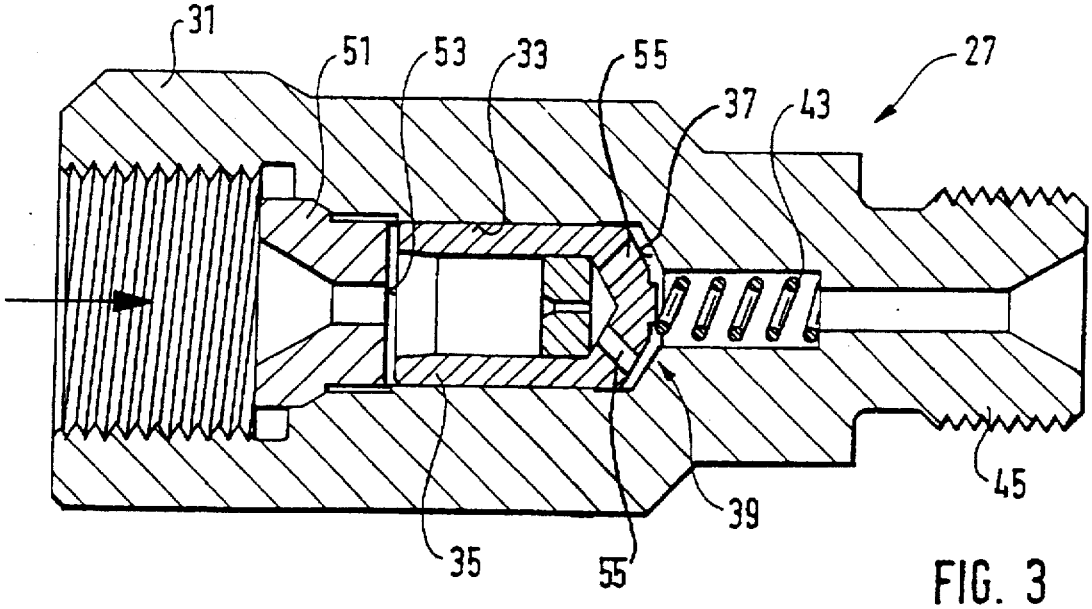
FIG. 3 shows a section through a second exemplary embodiment of a through flow limiting valve with throttle bores in the end wall of the valve member.

The second exemplary embodiment of the through flow limiting valve 27 shown in FIG. 3 in the open position differs from the first exemplary embodiment shown in FIG. 2 merely in the disposition of the throttle location, which are constituted by means of throttle bores 55 in the closed end face of the valve member 35, which forms the valve sealing face 37. These throttle bores 55 are in lieu of the through openings 41 shown in FIG. 2.

The operation of the through flow limiting valves 27, which is described in detail below in conjunction with the graph in FIG. 4, can be achieved only by means of the matching, according to the invention, of the throttle cross sections at the valve member 35 and the spring force of the restoring spring 43 as a function of the flow rate at the injection valve 23 and the flow rate at the through flow limiting valve 27.

The matching of the throttle cross section and restoring force is carried out in such a way that the pressure drop in the high pressure line 21 during the fuel injection at the injection valve 23 is already sufficient to produce a stroke motion of the valve member 35 in the direction of the valve seat 39. The diameter and maximum stroke of the valve member 35 are designed so that when the high pressure line 21 is undamaged, this closing stroke motion of the valve member 35 is not carried out all the way to the valve seat 39, even at the maximum injection rate and consequently the maximum flow rate, so that the through flow limiting valve 27 does not close (FIG. 3). After the end of the fuel injection at the injection valve 23, the pressure in the high pressure line between the through flow limiting valve 27 and injection valve 23 builds back up via the opening cross section that still remains in the through flow limiting valve 27, to the pressure of the high pressure line between the high pressure accumulation chamber 11 and the through flow limiting valve 27, wherein the force now acting on the valve member 35 moves it back into its initial open position.

To this end, the flow rate of the fuel flow at the through flow limiting valve 27 that can be adjusted through the valve cross section, the force of the restoring spring 43, and the design of the throttle cross section in the valve member 35 of the through flow limiting valve 27, is adjusted so that at the maximum permissible speed and injection quantity, more than the maximum permissible injection quantity flows through during the injection pause.

This event repeats itself from injection to injection, wherein when the high pressure line 21 is undamaged, the valve member 35 never reaches the valve seat 39 and the through flow limiting valve 27 consequently does not close. This valve member stroke in the opening and closing direction is represented in the graph in FIG. 4, where the solid line corresponds to an undamaged operation.

In the event of damage (low leakage quantity), the pressure in the high pressure line 21 to the injection valve 23 can no longer completely build up in the injection pauses so that a pressure difference remains upstream and downstream of the through flow limiting valve 27, which has the effect that the restoring movement of the valve member 35 following an injection phase is smaller during the injection pause than in undamaged operation. As shown by the dashed line in the graph in FIG. 4, this restoring movement now merely occurs up to a higher initial level of the opening position.

During the subsequent injection process, the valve member 35 is moved again, as described, by the same stroke path toward the valve seat 39, and now reaches the valve seat 39 due to the increased initial level in this (or a later) injection so that the through flow limiting valve 27 is closed. Since during the subsequent injection pause, no pressure compensation now occurs in the high pressure line 21 upstream and downstream of the through flow limiting valve 27 (spring force is smaller than the force from the standing pressure in the line), the through flow limiting valve 27 remains securely closed and thus prevents an undesired escape of fuel in the damaged high pressure line.

Figure 4:
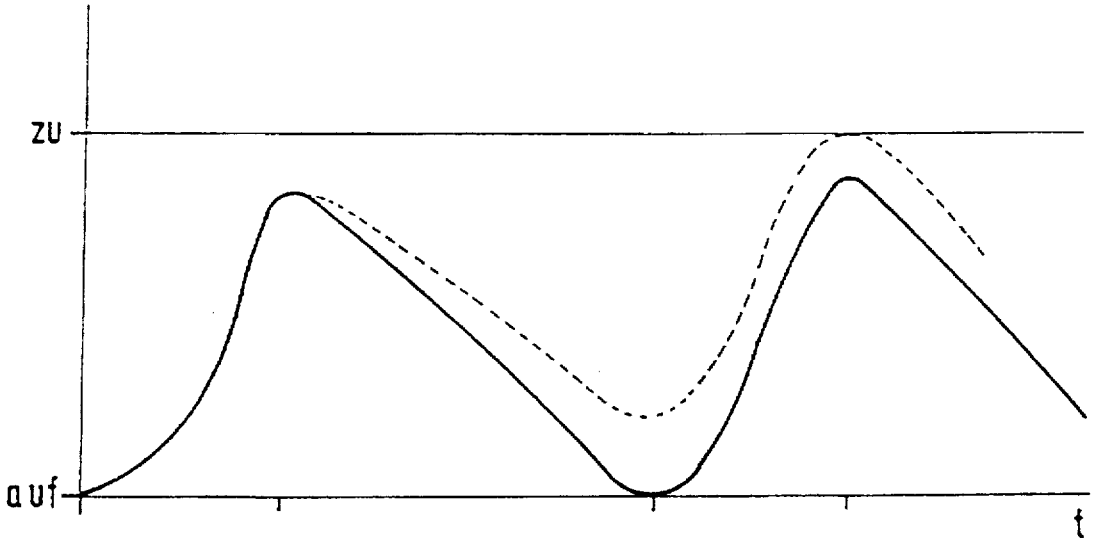
FIG. 4 is a graph which represents the course of the valve member stroke motion of two, with and without slight leakage quantities in the high pressure line, over the time of two injections in the injection valve.

The complete closing of the through flow limiting valve 27 as shown in FIG. 4 can already occur after two injection phases and valve member strokes. Particularly with very small leakage quantities, though, it is also possible that the complete closing of the through flow limiting valve 27 occurs only after a number of injections, wherein the valve member 35 essentially approaches an initial level of this kind, which is sufficient for reaching the valve seat 39 during the stroke motion during injection. The speed of the closing time or the sensitivity of the detection of small leakage quantities can be precisely adjusted by means of the spring and throttle matching as a function of predetermined leakage quantities.

When there are large leakage quantities and large pressure differences upstream and downstream of the through flow limiting valve 27, the through flow quantity in it is so large that a maximum value of the throttle resistance, which can be adjusted via the throttle cross section, is exceeded. As a result, almost no more fuel flows through the valve member 35, rather, the fuel flowing against the valve member 35 immediately moves it counter to the force of the restoring spring 43 until it contacts the valve seat 39 and holds it there securely so that the through flow limiting valve closes rapidly and reliably in the event of a damage with large leakage quantities.

The restoring spring 43 is dimensioned so that in undamaged operation, at the maximum permissible through flow quantity in the valve member 35, the restoring spring, together with the standing pressure in the high pressure line 21 or the high pressure accumulation chamber 11, reliably holds the valve member lifted up from the valve seat 39, even after the execution of the stroke motion in the direction of the valve seat 39. However, if this standing pressure that acts as an additional counterpressure in the opening direction in the high pressure line 21, drops, e.g. as a result of the breakage of this line and an uncontrolled escape of fuel from it, then the force of the restoring spring 43 alone is no longer sufficient to hold the valve member 35 up off of the seat 39 counter to the force of the fuel flowing against the throttle location, and the through flow limiting valve 27 closes.

It is consequently possible with the design and operation of the through flow limiting valve 27 according to the invention to already detect an undesired escape of fuel in fuel injection devices at very small leakage quantities as well as at high leakage rates in the high pressure line 21 and to reliably prevent them by closing the through flow limiting valve 27.

The foregoing relates to preferred exemplary embodiments of the invention, it being understood that other variants and embodiments thereof are possible within the spirit and scope of the invention, the latter being defined by the appended claims.

What is claimed is:

1. A fuel injection device for internal combustion engines comprising a high pressure fuel pump (1) that delivers fuel from a low pressure chamber (7) via high pressure lines (9, 21) to at least one injection valve (23) that protrudes into the combustion chamber of the engine to be fed, a through flow limiting valve (27) that defines a maximum fuel flow quantity in at least one high pressure line (9, 21), said flow limiting valve (27) has a cup-shaped valve member (35) that moves axially, an open end of said flow limiting valve (27) is connected to a part of the high pressure line (21) that is connected to the high pressure pump (1) and a closed end face of said flow limiting valve constitutes a valve sealing face (37) that cooperates with a valve seat (39), wherein at least one through opening (41) is provided in the closed end face of said flow limiting valve and an outflow opening is disposed in the valve sealing face (37) upstream of the valve seat (39) when viewed in the infection flow direction, and in a closed position said limiting valve is brought against said valve seat (39) counter to a force of a restoring spring (43) by the fuel flowing from said high pressure line toward the injection valve (23) when a maximum fuel flow quantity is exceeded, wherein the fuel flow through the valve member (35) that is lifted from its seat (39) is adjusted in at least one throttle location (49, 55) in the valve member (35), a throttle cross section of the valve member (35) and a spring rigidity of the restoring spring (43) are tuned as a function of a flow rate in the injection valve (23) in such a way that an adjustment movement of the valve member (35) of the through flow limiting valve (27) in the closing direction is already executed during the injection process in the injection valve (23), which movement is smaller than a maximum stroke of said valve member, that in an undamaged operation, the valve member (35) of the through flow limiting valve (27) returns to an initial position during injection pauses, and that in an event of a leaky high pressure line (21) between the through flow limiting valve (27) and the injection valve (23), the valve member (35) of the through flow limiting valve (27) is not returned to its original starting position and remains seated on said valve seat (39).

2. A fuel injection device according to claim 1, in which the flow rate of the fuel flow in the through flow limiting valve (27), which flow rate can be adjusted through the valve cross section, the force of the restoring spring (43), and the design of the throttle cross section in the valve member (35) of the through flow limiting valve (27), is so high that during an injection pause, more than the permissible injection quantity flows through at a maximum permissible speed of the engine and a maximum permissible injection quantity.

3. The fuel injection device according to claim 1, in which the through opening in the closed end face (37) of the valve member (35) of the through flow limiting valve (27) is embodied as a throttle bore (55).

4. A fuel injection device according to claim 1, in which the valve member (35) of the through flow limiting valve (27) has a throttle insert (47) with a throttle location (49).

5. A fuel injection device according to claim 1 in which the valve sealing surface (37) of the valve member (35) and the valve seat (39) of the through flow limiting valve (27) are embodied as conical.

6. A fuel injection device according to claim 1, in which the restoring spring (43) of the through flow limiting valve (27) is clamped between a flat part of the valve sealing face (37) on the valve member (35) and a bored step of a through bore (33).

7. A fuel injection device according to claim 1, in which a common high pressure accumulation chamber (11) is inserted into the high pressure lines (9, 21) between the high pressure fuel pump (1) and the injection valves (23), into which chamber the high pressure fuel pump (1) feeds and from which the individual high pressure lines (21) lead to the injection valves (23).

* * * * *